US010094001B2

(12) United States Patent
Nakajima et al.

(10) Patent No.: US 10,094,001 B2
(45) Date of Patent: Oct. 9, 2018

(54) METHOD FOR PRODUCING EUTECTIC COPPER-IRON ALLOY

(71) Applicants: Iwao Nakajima, Hokkaido (JP); Guoqiao Lai, Hangzhou (CN)

(72) Inventors: Iwao Nakajima, Hokkaido (JP); Guoqiao Lai, Hangzhou (CN)

( * ) Notice: Subject to any disclaimer, the term of this patent is extended or adjusted under 35 U.S.C. 154(b) by 158 days.

(21) Appl. No.: 15/036,611

(22) PCT Filed: Nov. 11, 2014

(86) PCT No.: PCT/JP2014/079831

§ 371 (c)(1),
(2) Date: May 13, 2016

(87) PCT Pub. No.: WO2015/072448

PCT Pub. Date: May 21, 2015

(65) Prior Publication Data

US 2016/0265086 A1 Sep. 15, 2016

(30) Foreign Application Priority Data

Nov. 13, 2013 (JP) ..... 2013-235214

(51) Int. Cl.

| | |
|---|---|
| ***C22C 9/00*** | (2006.01) |
| ***C22C 1/02*** | (2006.01) |
| ***B22D 7/00*** | (2006.01) |
| ***B22D 7/02*** | (2006.01) |
| ***B22D 7/06*** | (2006.01) |

(Continued)

(52) U.S. Cl.

CPC ..... *C22C 1/02* (2013.01); *B22D 7/005* (2013.01); *B22D 21/00* (2013.01); *B22D 21/005* (2013.01); *C22C 9/00* (2013.01); *C22F 1/08* (2013.01)

(58) Field of Classification Search

CPC ..... C22C 1/02; B22D 7/005

See application file for complete search history.

(56) References Cited

FOREIGN PATENT DOCUMENTS

| | | | |
|---|---|---|---|
| CN | 101104896 | A | 1/2008 |
| CN | 101274364 | A | 10/2008 |

(Continued)

OTHER PUBLICATIONS

Feb. 17, 2015 International Search Report issued in International Patent Application No. PCT/JP2014/079831.

(Continued)

*Primary Examiner* — Deborah Yee

(74) *Attorney, Agent, or Firm* — Oliff PLC

(57) ABSTRACT

Method for producing eutectic copper-iron alloy in which crystal grain fragments containing iron are dispersed in a copper matrix, includes: a charging step charging a first melting furnace (MF) and second MF respectively with electrolytic-copper and pure iron grain fragments; molten copper (MC) deoxidizing step heating electrolytic-copper to at least melting-point in the first MF, melting and deoxidizing the electrolytic-copper; molten iron (MI) deoxidizing step heating pure iron to at least melting-point in the second MF, melting and deoxidizing pure iron; MI transfer step increasing the MI temperature generated in the second MF; transferring the MI to a primary reaction furnace; MC transfer step increasing the MC temperature in the first MF to at least the iron melting-point; transferring the MC to the primary reaction furnace; and a reaction step causing a crystallization reaction between copper in the MC and iron in the MI in the primary reaction furnace.

7 Claims, 2 Drawing Sheets

(51) Int. Cl.

| | |
|---|---|
| ***B22D 21/00*** | (2006.01) |
| ***B22D 21/06*** | (2006.01) |
| ***C22F 1/08*** | (2006.01) |

(56) References Cited

FOREIGN PATENT DOCUMENTS

| | | | |
|---|---|---|---|
| JP | H01-133640 | A | 5/1989 |
| JP | H06-17163 | A | 1/1994 |
| WO | 2011/142005 | A1 | 11/2011 |

OTHER PUBLICATIONS

Dec. 15, 2015 International Preliminary Report on Patentability issued in International Patent Application No. PCT/JP2014/079831.
Jul. 4, 2017 Office Action issued in Chinese Patent Application No. 201480058930.0.
Jun. 27, 2017 Search Report issued in Chinese Patent Application No. 2014800589300.
Apr. 15, 2013 Thesis for Master's Degree.

METHOD FOR PRODUCING EUTECTIC COPPER-IRON ALLOY

BACKGROUND OF THE INVENTION

Field of the Invention

The present invention relates to a method for producing an eutectic copper-iron alloy in which an intermetallic compound of Cu and Fe (hereinafter, referred to as a "Cu/Fe intermetallic compound") is dispersed in a Cu matrix containing Cu as its main constituent, and more particularly, a method for producing a CFA (Cu—Fe Alloy) which is a copper-iron new ceramic. The present application claims priority based on the Japanese Patent Application No. 2013-235214 filed on Nov. 13, 2013 in Japan, which is incorporated by reference herein.

Description of Related Art

In recent years, for example, like thin plates typified by lead frame materials for ICs and LSIs, low-cost electronic materials with high strength and high electrical conductivity have been requested in various fields, and copper-iron alloys have been attracting attention as materials that meet such requests. Copper and iron are metals that form no solid solution with each other, only finely dispersed individually due to segregation and the like during melting when the copper and the iron are produced by a conventional method through melting and solidification, and considered to have trouble with hot workability. However, in recent years, melting and rapid cooling methods that are similar to methods for producing stainless steel have been developed, which make it possible to produce thin plate-like copper-iron alloys.

As such a method for producing a copper-iron alloy, Patent Literature 1 discloses a method for producing an eutectic copper-iron alloy, in which Fe is input into a furnace, the Fe is charged with Cu on completely melting Fe, a crystallization reaction is developed, and the molten reaction product is transferred into an ingot case. The ingot obtained by the production method has crystal fragments of a Cu/Fe intermetallic compound distributed homogeneously in a matrix containing Cu as its main constituent, and serve as various industrial materials through plastic working such as extruding, rolling, and drawing. These composite materials have crystal fragments of a Cu/Fe intermetallic compound as a high-permeability body, which are dispersed in a Cu matrix, and thus have great properties as a shield material against electromagnetic waves.

Patent document 1: Japanese Patent Application Laid-Open No. 1994-017163

BRIEF SUMMARY OF THE INVENTION

However, in the production method in Patent Literature 1, the molten Fe charged with the solid Cu, the surface of molten metals is thus disturbed significantly, and bubbles are likely to be blended. In addition, the crystallization reaction between Cu and Fe is immediately started, a solid phase is precipitated in the liquid phase, and the proportion of the solid phase to the liquid phase is increased to increase the viscosity of the molten phase, and thus, all bubbles are not able to be removed even in the case of degassing in a vacuum furnace. In addition, the molten phase has not only air blended therein, but also cracked gases of stain of oil film adhering to raw materials therein. It is difficult to eliminate the fine bubbles blended in the molten phase by processing such as forging and extruding.

When an ingot such as an ingot and a billet has gas cavities formed with bubbles blended in the molten phase, the gas cavities constitute a major obstacle to plastic working. In particular, in drawing of fine lines on the order of 0.1 mm in diameter, even fine gas cavities in the ingot cause disconnection. For this reason, in the production of copper-iron alloys, methods have been desired which completely expel bubbles in molten metal.

In addition, eutectic copper-iron alloys are metals which have both high electrical conductivity and strong magnetism, and optimum as shield materials for both electric fields and magnetic fields, and the alloys thus have properties such as an ability to shield against microwaves. In order to ensure that eutectic copper-iron alloys have the properties, it is preferable for fine iron particles to be dispersed homogeneously in copper matrices. For this reason, it is desirable to efficiently produce eutectic copper-iron alloys in which crystal fragments of a Cu/Fe intermetallic compound as a high-permeability magnetic body are dispersed in a more reliably uniform fashion in Cu matrices.

The present invention has been made in view of the problem mentioned above, and an object of the present invention is to provide a novel and improved method for producing an eutectic copper-iron alloy, which is capable of reducing bubble mixed, and efficiently producing a high-quality eutectic copper-iron alloy in which crystal grains of a Cu/Fe intermetallic compound are dispersed in a homogeneous fashion.

An aspect of the present invention is a method for producing an eutectic copper-iron alloy including CFA (Cu—Fe Alloy) that is a copper-iron new ceramic in which crystal grain fragments containing iron are dispersed in a copper matrix, which includes: a charging step of charging a first melting furnace with electrolytic copper, and a second melting furnace with pure iron grain fragments, in which the second melting furnace is separated from the first melting furnace; a molten copper deoxidizing step of heating and thus melting the electrolytic copper to 1400° C. in the first melting furnace, thus deoxidizing an oxygen-containing gas in the molten copper; a molten iron deoxidizing step of heating and thus melting the pure iron to 1600° C. in the second melting furnace, thus deoxidizing an oxygen-containing gas in the molten iron; a molten iron transfer step of further increasing a temperature of the molten iron generated in the second melting furnace to 1650° C., and then transferring the molten iron to a primary reaction furnace which is separated from the first melting furnace and the second melting furnace; a molten copper transfer step of increasing a temperature of the molten copper generated in the first melting furnace to 1550° C. after the molten iron transfer step, and then transferring the molten copper to the primary reaction furnace; a reaction step of heating the primary reaction furnace to 1600° C. and causing a crystallization reaction between copper contained in the molten copper and iron contained in the molten iron in the primary reaction furnace; a molten mixture transfer step of transferring a molten mixture generated in the primary reaction furnace into a mold; a cooling step of cooling the molten mixture transferred into the mold; and a processing step of processing a cast product generated in the mold.

According to an aspect of the present invention, the convection of both the molten metals in which the oxygen-containing gas is sufficiently deoxidized before the Cu/Fe crystallization reaction which increases the molten viscosity prevents copper-iron from being separated into two layers, thereby causing the copper and the iron to make intermetallic chemical combinations in multiple aspects. For this reason, a high-quality eutectic copper-iron alloy can be effectively produced in which bubbles mixed are reduced, and crystal grains of a Cu/Fe intermetallic compound are dispersed in a homogeneous fashion.

In addition, in an aspect of the present invention, high-frequency electric furnaces may be used as the primary reaction furnace, the first melting furnace, and the second melting furnace.

In accordance with this aspect, each molten metal is vigorously agitated by induction power in each melting furnace, and pure iron grain fragments in the molten copper can be thus dispersed in a homogeneous fashion in the primary reaction furnace after reducing the viscosity of each molten metal to sufficiently deoxidize the gas.

In addition, in an aspect of the present invention, a deoxidizing agent containing at least silicon may be added into the molten copper in the molten copper deoxidizing step.

In accordance with this aspect, the deoxidization of the molten copper can be accelerated, and bubbles blended into the molten copper can be reliably reduced.

In addition, in an aspect of the present invention, a deoxidizing agent containing at least ferrosilicon may be added into the molten iron in the molten iron deoxidizing step.

In accordance with this aspect, the deoxidization of the molten iron can be accelerated, and bubbles blended into the molten iron can be reliably reduced.

In addition, in an aspect of the present invention, the molten mixture may be transferred into a mold that forms a sheet bar from the molten mixture in the molten mixture transfer step, and then rapidly cooled to 100° C. or lower in the cooling step.

In accordance with this aspect, the growth of dendrite formed on the sheet bar can be inhibited.

In addition, in an aspect of the present invention, the molten mixture may be transferred into a mold that forms a billet from the molten mixture in the molten mixture transfer step, and then slowly cooled to 300° C. or lower in the cooling step.

In accordance with this aspect, the growth of dendrite formed on the billet can be accelerated.

In addition, in an aspect of the present invention, the cast product may be subjected to hot forging to be formed into a billet for plastic working in the processing step.

In accordance with this aspect, the hot forging makes it possible to disorder crystals of dendrite, and improve the anisotropic property of an eutectic copper-iron alloy to an isotropic property.

According to the present invention as described above, the convection of both the molten metals in which the oxygen-containing gas is sufficiently deoxidized before the Cu/Fe crystallization reaction which increases the molten viscosity prevents copper-iron from being separated into two layers, thus causing the copper and the iron to make intermetallic chemical combinations in multiple aspects. For this reason, a high-quality eutectic copper-iron alloy can be effectively produced in which bubbles mixed are reduced, and crystal grains of a Cu/Fe intermetallic compound are dispersed in a homogeneous fashion.

DETAILED DESCRIPTION OF THE INVENTION

Preferred embodiments of the present invention will be described in detail below. It is to be noted that the present embodiments described below are not intended to unduly limit the scope of the present invention as specified in the claims, and what is described in the present embodiments is not always all indispensable as the solving means of the present invention.

Figure 1:
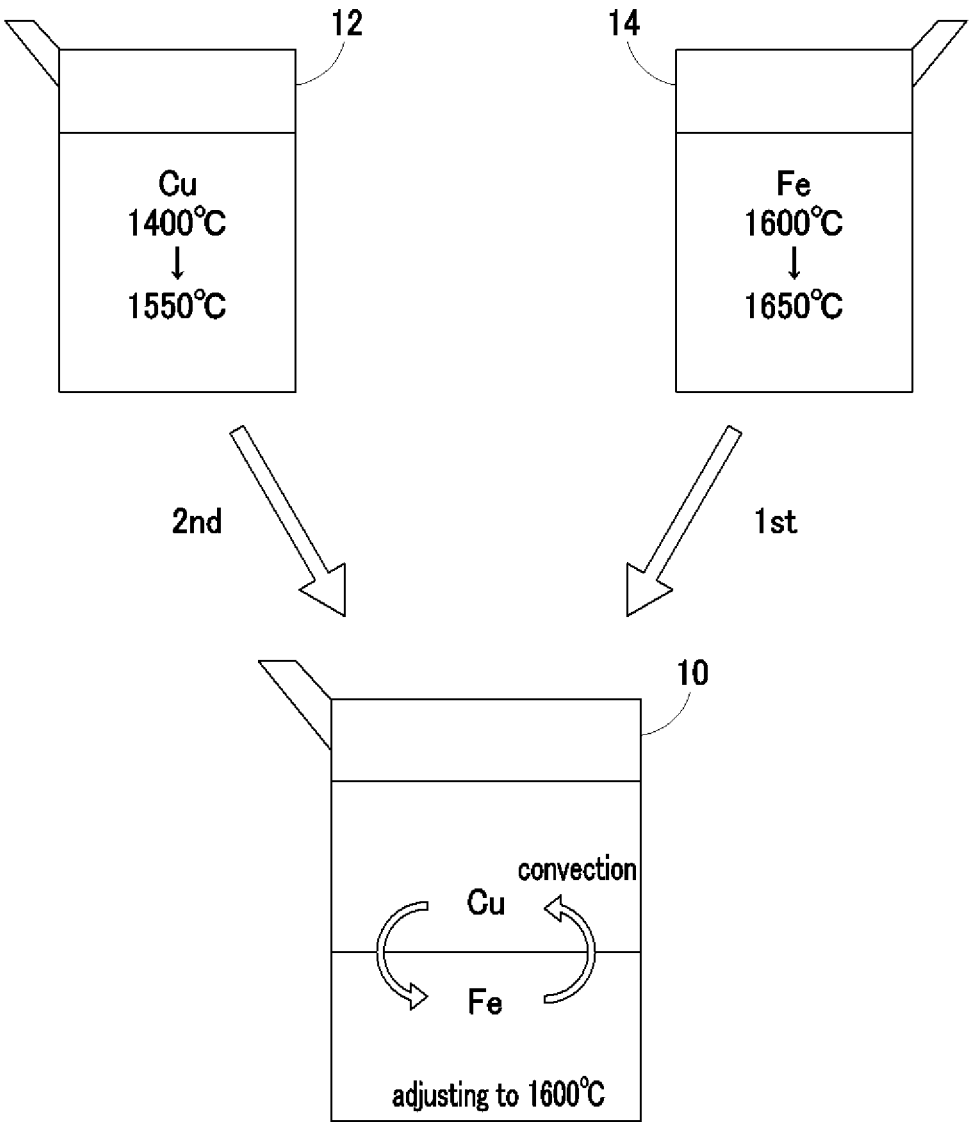
FIG. 1 is an explanatory figure illustrating an outline of a method for producing an eutectic copper-iron alloy according to an embodiment of the present invention.

First, a summary of a method for producing an eutectic copper-iron alloy according to an embodiment of the present invention will be described with reference to the drawing. FIG. 1 is an explanatory figure illustrating an outline of a method for producing an eutectic copper-iron alloy according to an embodiment of the present invention.

The method for producing an eutectic copper-iron alloy according to the present embodiment is characterized in that separately prepared high-frequency electric furnaces are used for a melting furnace that generates molten copper, a melting furnace that generates molten iron, and a primary reaction furnace that causes a crystallization reaction between copper contained in the molten copper and iron contained in the molten iron. More specifically, in the present embodiment, as shown in FIG. 1, prepared separately from each other are: a first melting furnace 12 that generates molten copper; a second melting furnace 14 that generates molten iron; and a primary reaction furnace 10 that mixes the molten copper and the molten iron to cause a crystallization reaction between the copper contained in the molten copper and the iron contained in the molten iron. It is to be noted that the term "eutectic copper-iron alloy" is considered to refer to a broadly-defined metal-related material including CFA (Cu—Fe Alloy) as a copper-iron new ceramic that has intermediate properties between a metal and a ceramic in this specification.

In addition, in the present embodiment, high-frequency electric furnaces are used as the primary reaction furnace 10, the first melting furnace 12, and the second melting furnace 14 in order to vigorously agitate the molten metals in the furnaces by induced power, and the primary reaction furnace 10, the first melting furnace 12, and the second melting furnace 14 are characterized by being formed from a magnesia brick with refractoriness of SK38 or more. In particular, also for preventing a cementite ($Fe_3C$) reaction in the process of generating an eutectic copper-iron alloy in the primary reaction furnace 10, it is preferable to use a high-frequency electric furnace formed from a magnesia brick with refractoriness of SK38 or more for the primary reaction furnace 10. In addition, burning furnaces or electric furnaces can be used as the first and second melting furnaces 12, 14, but it is preferable to use high-frequency induction furnaces as one of the electric furnaces from the perspective of producing a high-quality eutectic copper-iron alloy.

The first melting furnace 12 is charged with electric copper, and the electric copper is heated to at least the melting point thereof or higher, for example, 1400° C., thus melted to generate molten copper. In the present embodiment, a high-frequency induction furnace is used as the first melting furnace 12, thus, in the process of generating molten copper in the first melting furnace 12, the molten copper is agitated by induction power, and the gas in the molten copper is expelled. The gas contains oxygen, and the degassing step includes a deoxidizing step. In addition, in the present embodiment, in transferring the molten copper from the first melting furnace 12 to the primary reaction furnace 10, in order to ease extrusion transfer with a tube and prevent the disturbance caused by a difference in temperature from the molten iron transferred to the primary reaction furnace 10, the first melting furnace 12 is, before transferring the generated molten copper to the primary reaction furnace 10, further heated to increase the temperature to 1550° C., so as to make the molten copper higher than the melting temperature of iron.

The second melting furnace 14 is charged with pure iron grain fragments, and the pure iron grain fragments are heated to at least the melting point thereof or higher, for example, 1600° C., thus melted to generate molten iron. In the present embodiment, a high-frequency induction furnace is used as the second melting furnace 14, thus, in the process of generating molten iron in the second melting furnace 14, the molten iron is agitated by induction power, and the gas in the molten iron is expelled, and at the same time, deoxidized. In addition, in the present embodiment, in order to develop an efficient crystallization reaction with the molten iron in the primary reaction furnace 10, the second melting furnace 14 is, before transferring the generated molten iron to the primary reaction furnace 10, further heated to increase the temperature to 1650° C. More specifically, in order to facilitate the convergence of the temperature of the molten mixture with the molten copper at 1550° C. in the primary reaction furnace 10 to 1600° C., the molten iron is further heated to increase the temperature to 1650° C.

The primary reaction furnace 10 mixes the molten copper transferred from the first melting furnace 12 and the molten iron transferred from the second melting furnace 14 and cause a crystallization reaction between the copper contained in the molten copper and the iron contained in the molten iron to generate a molten mixture that has a temperature adjusted to 1600° C. In the present embodiment, in order to cause the molten mixture of the molten iron and the molten copper to develop a sufficient crystallization reaction in the primary reaction furnace 10, the molten iron at 1650° C., generated in the second melting furnace 14, is first transferred to the primary reaction furnace 10, and then, the molten copper at 1550° C., generated in the first melting furnace 12, is transferred to the primary reaction furnace 10. More specifically, in the primary reaction furnace 10, the molten copper at 1550° C., generated in the first melting furnace 12, is transferred to the molten iron at 1650° C., generated in the second melting furnace 14. In the transfer of the molten copper and the molten iron to the primary reaction furnace 10, in order to prevent gases containing oxygen or the like and cracked gases of stain of oil film adhering to raw materials, etc. from being mixed as bubbles, the transfer is carried out while concerning about avoiding the disturbance of the fluid level.

In addition, copper and iron differ from each other in melting point and density as shown in Table 1 below. More specifically, the iron is higher in melting point, whereas the copper is higher both in solid density and liquid density. For this reason, in the present embodiment, the molten iron which is lower in density and higher in melting point is first transferred to the primary reaction furnace 10, and the molten copper which is higher in density and lower in melting point is then transferred thereto, thereby because there are a density difference and a temperature difference between the upper layer of the molten copper and the lower layer of the molten iron, preventing the separation into two layers due to the convection caused by the differences, and starting intermetallic chemical combinations between the metals in multiple aspects. For this reason, a high-quality eutectic copper-iron alloy comes to be reliably generated in which crystal grain fragments of a Cu/Fe intermetallic compound containing iron as a highly magnetic body are dispersed efficiently in the copper matrix in a more homogeneous fashion.

TABLE 1

| Composition | Unit | Cu | Fe | Difference | $CuFe_6$ | $CuFe_3$ |
|---|---|---|---|---|---|---|
| Melting Point | ° C. | 1083 | 1535 | 452 | | |
| Solid Density | $kg/m^3$ | 8960 | 7874 | 1086 | 7909 | 7796 |
| Liquid Density | $kg/m^3$ | 7940 | 7035 | 905 | | |

Furthermore, in the present embodiment, a high-frequency induction furnace is used as the primary reaction furnace 10, the molten mixture is thus agitated by induction power in the process of generating the molten mixture while causing the mixture to develop a crystallization reaction in the primary reaction furnace 10, and the viscosity of the molten mixture can be lowered to achieve sufficient deoxidization of the gas. For this reason, in the primary reaction furnace 10, due to homogeneously dispersed pure iron grain fragments in the molten copper, the viscosity of the molten copper can be lowered to achieve sufficient deoxidization of the gas, thus generating a good-quality eutectic copper-iron alloy with a reduced mixture of bubbles.

In addition, the first melting furnace 12 that generates molten copper, the second melting furnace 14 that generates molten iron, and the primary reaction furnace 10 that mixes the molten copper and the molten iron to cause a crystallization reaction between the copper contained in the molten copper and the iron contained in the molten iron are prepared separately from each other in the present embodiment. As described previously, a high-frequency electric furnace are used for each of the first melting furnace 12, the second melting furnace 14, and the primary reaction furnace 10, and the temperatures of the molten melts are increased while vigorously agitating the molten melts in the furnaces by induction power. For this reason, the separate preparation of the furnaces 10, 12, 14 makes it easy to adjust the respective furnaces 10, 12 14 to desired different temperatures, thus making it possible to efficiently generate an eutectic copper-iron alloy.

Figure 2:
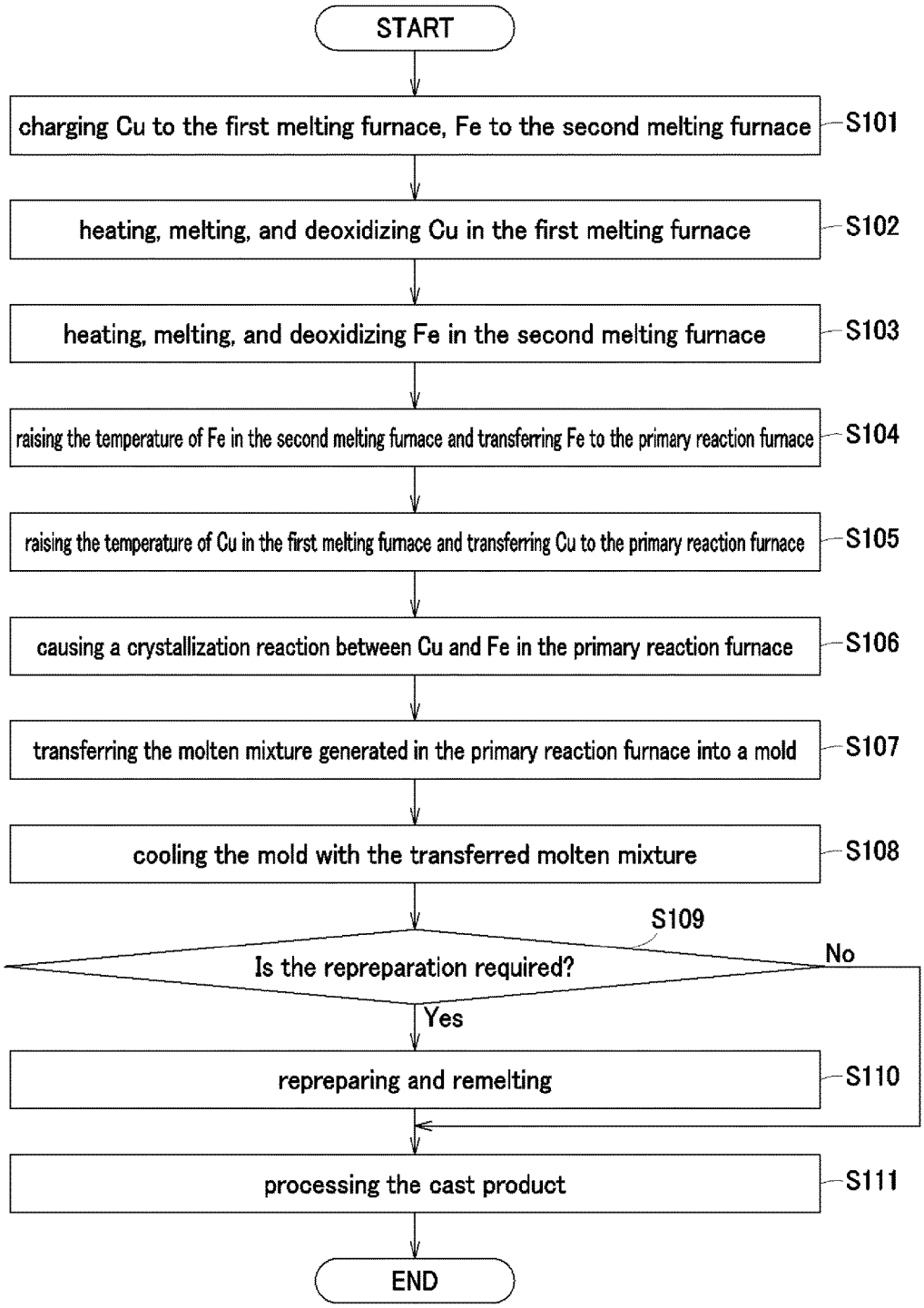
FIG. 2 is a flowchart showing a flow of a method for producing an eutectic copper-iron alloy according to an embodiment of the present invention.

Next, a flow of a method for producing an eutectic copper-iron alloy according to an embodiment of the present invention will be described with reference to the drawing. FIG. 2 is a flowchart showing a flow of a method for producing an eutectic copper-iron alloy according to an embodiment of the present invention.

The method for producing an eutectic copper-iron alloy according to the present embodiment is intended to make it possible to efficiently produce, in particular, a CFA (Cu—Fe Alloy) that is a copper-iron new ceramic, among eutectic copper-iron alloys in which a Cu/Fe intermetallic compound of crystal grain fragments containing iron is dispersed in a copper matrix. Among the eutectic copper-iron alloys, the CFA is a copper-iron new ceramic that has intermediate properties between a metal and a ceramic, which has both properties of copper and iron, changes magnetic waves and electric waves to electric currents with one material, and has the ability to be freely processed depending on the intended use such as a thin plate, a rod, and a fine line. For this reason, the CFA is a useful and new metal-related material which is applicable to electrically conductive materials, electrical heating materials, electromagnetic shielding materials, structural materials, magnetic materials, spring materials, etc.

The method for producing an eutectic copper-iron alloy according to the present embodiment include a charging step S101, a molten copper deoxidizing step S102, a molten iron deoxidizing step S103, a molten iron transfer step S104, a molten copper transfer step S105, a reaction step S106, a molten mixture transfer step S107, a cooling step S108, a repreparation necessity determination step S109, a repreparation step S110, and a processing step S111. Further, these steps S101 through S111 are carried out in accordance with the flow shown in FIG. 2.

In the charging step S101, the first melting furnace 12 is charged with electrolytic copper and the second melting furnace 14 is charged with pure iron grain fragments, respectively. The electrolytic copper is a so-called electric copper that is obtained by electrolytically refining blister copper, which is pure copper with a purity of 99.99% or higher. The pure iron is iron that has a carbon content of 0.02% or less with very few other impurity elements, and the use of steels, in particular, the use of carbon steels is not allowed. In addition, the pure iron grain fragments preferably have a spherical shape subjected to spheroidizing treatment by annealing or the like. Furthermore, in the charging step S101, along with the electrolytic copper and the pure iron grain fragments, small amounts of cobalt, nickel, manganese, chromium, etc. may be added as an eutectic copper-iron alloy in order to achieve, for example, a great electromagnetic wave shielding effect.

In the molten copper deoxidizing step S102, the electrolytic copper in the first melting furnace 12 is heated to at least the melting point thereof or higher, and thus melted to deoxidize oxygen-containing gas in the molten copper. Specifically, the temperature of the first melting furnace 12 is adjusted to, for example, 1400° C., which is higher than the melting point (1083° C.) of Cu and lower than the melting point (1535° C.) of Fe, thereby melting the electrolytic copper to generate molten copper. It is to be noted that the temperature of the first melting furnace 12 preferably falls within a higher temperature range from the perspective of acceleration of degassing.

In addition, in the molten copper deoxidizing step S102, the electrolytic copper is melted, and the temperature of the first melting furnace 12 is then kept to sufficiently expel the gas in the molten copper. The degassing time is, depending on the input of the electrolytic copper, approximately 20 to 50 minutes, for example, in the case of an input of 100 kg.

Furthermore, in the present embodiment, in order to accelerate the deoxidization of the molten copper, and reliably reduce bubbles blended into the molten copper, a deoxidizing agent containing at least silicon is added into the molten copper in the molten copper deoxidizing step S102. It is to be noted that a deoxidizing material containing phosphorus, lithium, etc. besides silicon may be used as a deoxidizing material for Cu.

In the molten iron deoxidizing step S103, the pure iron in the second melting furnace 14 is heated to at least the melting point thereof or higher, and thus melted to deoxidize oxygen-containing gas in the molten iron. Specifically, the temperature of the second melting furnace 14 is adjusted to, for example, 1600° C., which is at least higher than the melting point (1535° C.) of Fe, thereby melting the pure iron to generate molten iron. It is to be noted that the temperature of the second melting furnace 14 preferably falls within a higher temperature range from the perspective of acceleration of degassing.

In addition, in the molten iron deoxidizing step S103, the pure iron is melted, and the temperature of the second melting furnace 14 is then kept to sufficiently expel the gas in the molten iron. The degassing time is, depending on the input of the pure iron, approximately 20 to 50 minutes, for example, in the case of an input of 100 kg.

Furthermore, in the present embodiment, in order to accelerate the deoxidization of the molten iron, and reliably reduce bubbles blended into the molten iron, a deoxidizing agent containing at least ferrosilicon is added into the molten iron in the molten iron deoxidizing step S103. It is to be noted that a deoxidizing agent containing aluminum, manganese, titanium, silicon, etc. besides ferrosilicon may be used as a deoxidizing material for Fe.

It is to be noted that while the molten iron deoxidizing step S103 is carried out after the molten copper deoxidizing step S102 in the flowchart shown in FIG. 2, the molten iron deoxidizing step S103 may be carried out prior to the molten copper deoxidizing step S102, or the molten copper deoxidizing step S102 and the molten iron deoxidizing step S103 may be carried out at the same time to streamline the production of an eutectic copper-iron alloy, the melting furnaces that generate the molten copper and the molten iron are prepared separately from each other in the present embodiment.

In the molten iron transfer step S104, the temperature of the molten iron generated in the second melting furnace 14 is further increased to, for example, 1650° C., and the molten iron is then transferred to the primary reaction furnace 10. Thereafter, in the molten copper transfer step S105, the temperature of the molten copper generated in the first melting furnace 12 is increased to at least the melting point of iron or higher, for example, 1550° C., and the molten copper is then transferred to the primary reaction furnace 10. As just described, the molten copper is increased to the melting point of iron or higher, and then transferred to the primary reaction furnace 10 with the molten iron transferred thereto, thereby efficiently causing a crystallization reaction between copper and iron in the subsequent reaction step S106.

In addition, in the present embodiment, the molten iron which is lower in density and higher in temperature is first transferred to the primary reaction furnace 10, and the molten copper which is higher in density and lower in temperature than the molten iron is then transferred, thus causing convection due to a density difference and a temperature difference between the upper layer of the molten copper and the lower layer of the molten iron. For this reason, in the subsequent reaction step S106, the two layers of the molten copper and molten iron are prevented from being separated, thereby starting intermetallic chemical combinations between the metals in multiple aspects, and reliably generating a high-quality eutectic copper-iron alloy in which crystal grain fragments of a Cu/Fe intermetallic compound are dispersed efficiently in a copper matrix in a more homogeneous fashion.

The reaction step S106 causes the copper contained in the molten copper and the iron contained in the molten iron to develop a crystallization reaction in the primary reaction furnace 10. In the crystallization reaction step S106, the temperature of the primary reaction furnace 10 is made at least the melting point (1535° C.) of Fe or higher, for example, 1600° C. to turn the copper and the iron into molten states, and cause the copper and the iron to develop a crystallization reaction. The temperature of the primary reaction furnace 10 preferably falls within a higher temperature range from the perspective of acceleration and completion of the crystallization reaction. It is to be noted that the crystallization reaction time is, depending on the inputs of the raw materials, approximately 5 to 40 minutes, for example, in the case of an input of 200 kg in total. In addition, in the reaction step S106, small amounts of cobalt, nickel, manganese, chromium, etc. may be added in order to achieve a great electromagnetic shielding effect.

Fe has a low solubility of 2% in Cu, and thus mostly becomes a supersaturated constituent, which is immediately coupled to Cu, and furthermore, these coupled units repeat a crystallization reaction to grow to an intermetallic compound. The density of the intermetallic compound is, as shown previously in Table 1, 7909 kg/m$^3$ for $CuFe_6$ and 7796 kg/m$^3$ for $CuFe_3$, which are comparable to the density 7940 kg/m$^3$ of the Cu liquid phase, and the crystal grain fragments are thus also suspended in the dispersion medium. More specifically, in the reaction step S106, the molten mixture of the molten copper and molten iron as a high-temperature liquid phase, transferred to the primary reaction furnace 10, turns into a high-temperature solid-liquid mixture phase including a solid phase of the intermetallic compound and a liquid phase of the molten copper. The crystal grain fragments are fine with grain sizes from $10^{-9}$ to $10^{-7}$ m, and some of the crystal grain fragments are made spherical, whereas most of the fragments have a flat corded form. When the crystallization reaction is repeated to increase the concentration of the dispersed grain fragments, the mixture phase with the Cu liquid phase turns into a dispersion colloid to increase the flow resistance and produce a high viscosity.

In addition, when the Cu/Fe crystallization reaction is incomplete, Fe segregation is caused which leads to degraded quality, and when giant crystals are made by the growth of crystals, material properties are degraded. More specifically, when grain growth with intermetallic chemical combinations proceeds to increase the concentration of the solid phase, the viscosity of the molten solid-liquid mixture phase is rapidly increased, thereby accordingly diminishing the growth of the grains, and also attenuating the crystallization reaction. For this reason, it is preferable to optimize the reaction temperature and the reaction time, and further determine the extent of reaction in accordance with the change in the viscosity of the molten metals with intermetallic reaction. It is to be noted that the crystallization reaction time can be determined in response to the increase in viscosity.

In the molten mixture transfer step S107, the molten mixture generated in the primary reaction furnace 10 is transferred into a desired mold. For example, in the case of manufacturing a sheet bar as a cast product from the molten mixture, the mixture is transferred into a mold for forming the sheet bar in the molten mixture transfer step S107. Alternatively, in the case of manufacturing a billet as a cast product from the molten mixture, the mixture is transferred into a mold for forming the billet from the molten mixture in the molten mixture transfer step S107.

In the cooling step S108, the molten mixture transferred into the mold is cooled. More specifically, the molten mixture to serve as a high-temperature solid-liquid mixture phase, generated in the reaction step S106, is cooled to generate a copper-iron new ceramic that is a low-temperature composite. When the molten mixture is transferred into a mold for the sheet bar in the molten mixture transfer step S107 in order to manufacture the sheet bar as a cast product from the molten mixture, the mixture is rapidly cooled in water so as to reach, for example, 100° C. or lower, for the purpose of inhibiting the growth of dendrite formed on the sheet bar, on the grounds that the sheet bar has the form of a plate and has a great cooling effect. In contrast, when the molten mixture is transferred into a mold for the billet in the molten mixture transfer step S107 in order to manufacture the billet as a cast product from the molten mixture, the mixture is slowly cooled by natural cooling so as to reach, for example, 300° C. or lower, for the purpose of accelerating the growth of dendrite formed on the billet, on the grounds that the billet has the form of a substantially cuboid block and has a great heat-retaining effect. It is to be noted that the mold is preferably vibrated with an ultrasonic oscillator or the like in the cooling step S108 in order to obtain a copper-iron alloy ingot in which microcrystal grain fragments are dispersed in a homogeneous fashion.

It is to be noted that if necessary, pure copper may be appropriately added to the ingot obtained through the cooling step S108, prepared, and further melted again at a temperature of, for example, 1300° C. or higher and 1500° C. or lower. Specifically, when whether there is a need to reprepare a cast product or not is determined to determine that the repreparation is required depending on the intended use of the cast product in the repreparation necessity determination step S109, copper is added to adjust the Cu/Fe ratio for the repreparation, followed by remelting at 1400° C. in the repreparation step S110. The molten preparation remelted is, in the subsequent processing step S111, made into a billet by continuous casting, and the billet is subjected to hot working (such as extruding, rolling, and drawing) and heat treatment, thereby achieving commercialization of a stable material. It is to be noted that when it is determined that there is no need for any repreparation in the repreparation necessity determination step S109, the repreparation step S110 is skipped to proceed to the processing step S111.

In the processing step S111, the cast product generated in the mold is processed. Specifically, in the processing step S111, the ingot is subjected to plastic working (hot working, cold working), annealing, etc. for commercialization. For example, in the case of processing into a wire rod, the ingot is subjected to casting into a round bar material, and to hot rolling into a wire rod, and this wire rod is subjected to cold drawing more than once, thereby making wire drawing possible down to a fine line in the order of 0.1 mm in diameter. In addition, a cast product generated by the method for producing an eutectic copper-iron alloy according to the present embodiment is subjected to hot forging to be formed into a billet for plastic working in the processing step S111, thereby making it possible to disorder crystals of dendrite, and improve the anisotropic property of the eutectic copper-iron alloy to an isotropic property.

As just described, in the present embodiment, the convection of both the molten metals in which the oxygen-containing gas is sufficiently deoxidized before the Cu/Fe crystallization reaction which increases the molten viscosity prevents copper-iron from being separated into two layers, thereby causing the copper and the iron to make intermetallic chemical combinations in multiple aspects. For this reason, a high-quality eutectic copper-iron alloy can come to be produced efficiently, in which the mixture of bubbles is reduced, and crystal fragments of a Cu/Fe intermetallic compound are dispersed in a uniform fashion.

In particular, in the present embodiment, after transferring, to the primary reaction furnace 10, the molten iron generated by heating a temperature equal to or higher than the melting point of iron from the second melting furnace 14 to the primary reaction furnace 10, the molten copper heated to a temperature at least equal to or higher than the melting point of iron is transferred to the primary reaction furnace 10. For this reason, in the reaction step S106, the molten mixture of the molten copper and molten iron as high-temperature liquid phases transferred to the primary reaction furnace 10 turns into a high-temperature solid-liquid mixture phase including a solid phase of an intermetallic compound as crystal fragments of a Cu/Fe intermetallic compound and a liquid phase of the molten copper, and the makes it possible to efficiently produce CFA as a copper-iron new ceramic to serve as a low-temperature composite in the cooling step S108.

In addition, in the present embodiment, the melting furnaces 12, 14 that generate the molten copper and the molten iron are prepared separately from each other, the gases in the molten copper and the molten iron can be thus respectively expelled sufficiently in the molten copper deoxidizing step S102 and the molten iron deoxidizing step S103 before the Cu/Fe crystallization reaction which increases the molten viscosity. When molten copper and molten iron are mixed in the same melting furnace as in conventional cases, a crystallization binding reaction is caused between copper and iron in the liquid phase of the molten copper, thereby rapidly increasing the viscosity of the molten mixture, and thus making it difficult to have the molten mixture degassed. Accordingly, copper and iron are melted in the separate melting furnaces 12, 14, deoxidized, and then mixed in the primary reaction furnace 10 in the present embodiment.

EXAMPLES

Examples of the present invention will be described below. In the present embodiments, an ingot (1000 kg) of an eutectic copper-iron alloy (50Cu—50Fe) was produced by a method for producing an eutectic copper-iron alloy according to an embodiment of the present invention as described previously. Example 1 is an example in the case of generating an electrically conductive material as an eutectic copper-iron alloy by rapid cooling in the cooling step S108, and Example 2 is an example in which an electromagnetic wave shielding material as an eutectic copper-iron alloy is generated by gradual cooling in the cooling step S108. It is to be noted that the present invention is not to be considered limited to these examples.

Example 1

First, one furnace was installed for each of the primary reaction furnace 10 of 1000 kg in capacity, including a high-frequency electric furnace formed from a magnesia brick with refractoriness of SK38 or more; the first melting furnace 12 of 500 kg in capacity to serve as an auxiliary melting furnace for the generation of molten copper; and the second melting furnace 14 of 500 kg in capacity to serve as an auxiliary melting furnace for the generation of molten iron.

Next, the first melting furnace 12 was charged with high-purity electric copper for 500 kg. In that regard, a volatile solvent was used to clean contamination such as oil. Then, the first melting furnace 12 was heated to 1400° C. to melt and deoxidize the electric copper. For the deoxidization of the molten copper, silicon was used so that the deoxidization was completely achieved.

In addition, the second melting furnace 14 was charged with 500 kg of pure iron. In that regard, a volatile solvent was used to clean contamination such as oil. Then, the second melting furnace 14 was heated to 1600° C. to melt and deoxidize the pure iron. For the deoxidization of the molten iron, ferrosilicon was used so that the deoxidization is completely achieved.

Thereafter, the molten iron in the second melting furnace 14 was increased to 1650° C., and totally transferred to the primary reaction furnace 10, and then, the molten copper in the first melting furnace 12 was increased to 1550° C., and totally transferred to the primary reaction furnace 10. In regard to the transfer of the molten metals, the molten copper at 1550° C. was poured into the molten iron at 1650° C. while concerning about avoiding the disturbance of the fluid level. Then, the temperature of the molten mixture in the primary reaction furnace 10 was adjusted to 1600° C., and then kept. The reaction time for an eutectic reaction as intermetallic chemical combinations was adapted to 30 minutes. In this regard, due to the fact that there were a density difference and a temperature difference between the upper layer of the molten copper and the lower layer of the molten iron, the convection caused by the differences prevented the two layers from being separated, and starts intermetallic chemical combinations in multiple aspects.

On completion of the eutectic reaction in the primary reaction furnace 10, the molten metals with crystallized product in the primary reaction furnace 10 was transferred into a mold for the generation of a sheet bar, and rapidly cooled to provide a sheet bar. The dimensions (a×b×t) of the sheet bar was made as flat as possible to 250 mm×500 mm×30 mm. In this regard, in the mold, the molten metals with crystallized product started setting, and the increased dispersion density of grown grains caused the grown grains to aggregate and adhere through the action of an intermolecular force, and growed to a molecular lattice, crystal embryos, and dendrite. In particular, when crystal interfaces were fluctuated, the fluctuation served as a driving force to cause arborescent dendrite to grow. Thus, in the present example, rapid cooling was carried out in order to prevent the dendrite growth.

Thereafter, the sheet bar was reprepared depending on the intended use, and remelted at 1400° C. In this regard, in the repreparation, copper was added to the CFA50 as an eutectic copper-iron alloy to adjust the Cu/Fe ratio. In addition, in the remelting, the grown grains of the intermetallic compound were not decomposed. The molten repreparation was cooled to provide an ingot. Then, the ingot was subjected to hot forging at 800° C. to be formed into a billet for plastic working. It had been determined that this hot forging disordered crystals of dendrite, and improved the anisotropic property of the CFA as an eutectic copper-iron alloy to an isotropic property.

Example 2

First, one furnace was installed for each of: the primary reaction furnace 10 of 1000 kg in capacity, including a high-frequency electric furnace formed from a magnesia brick with refractoriness of SK38 or more; the first melting furnace 12 of 500 kg in capacity to serve as an auxiliary melting furnace for the generation of molten copper; and the second melting furnace 14 of 500 kg in capacity to serve as an auxiliary melting furnace for the generation of molten iron.

Next, the first melting furnace 12 was charged with high-purity electric copper for 500 kg. In that regard, a volatile solvent was used to clean contamination such as oil. Then, the first melting furnace 12 was heated to 1400° C. to melt and deoxidize the electric copper. For the deoxidization of the molten copper, silicon was used so that the deoxidization was completely achieved.

In addition, the second melting furnace 14 was charged with 500 kg of pure iron. In that regard, a volatile solvent was used to clean contamination such as oil. Then, the second melting furnace 14 was heated to 1600° C. to melt and deoxidize the pure iron. For the deoxidization of the molten iron, ferrosilicon was used so that the deoxidization was completely achieved.

Thereafter, the molten iron in the second melting furnace 14 was increased to 1650° C., and totally transferred to the primary reaction furnace 10, and then, the molten copper in the first melting furnace 12 was increased to 1550° C., and totally transferred to the primary reaction furnace 10. In regard to the transfer of the molten metals, the molten copper at 1550° C. was poured into the molten iron at 1650° C. while concerning about avoiding the disturbance of the fluid level. Then, the temperature of the molten mixture in the primary reaction furnace 10 was adjusted to 1600° C., and then kept. The reaction time for an eutectic reaction as intermetallic chemical combinations was adapted to 30 minutes. In this regard, due to the fact that there were a density difference and a temperature difference between the upper layer of the molten copper and the lower layer of the molten iron, the convection caused by the differences prevented the two layers from being separated, and started intermetallic chemical combinations in multiple aspects.

On completion of the eutectic reaction in the primary reaction furnace 10, the molten metals with crystallized product in the primary reaction furnace 10 was transferred into a mold for the generation of a billet, and slowly cooled to provide a billet. The dimensions (a×b×l) of the billet was made as block-like cuboid as possible to 150 mm×150 mm×225 mm. In this regard, in the mold, the molten metals with crystallized product started setting, and the increased dispersion density of grown grains caused the grown grains to aggregate and adhere through the action of an intermolecular force, and grow to a molecular lattice, crystal embryos, and dendrite. In particular, when crystal interfaces were fluctuated, the fluctuation served as a driving force to cause arborescent dendrite to grow. Thus, in the present example, slow cooling was carried out in order to accelerate the dendrite growth.

Thereafter, the sheet bar was reprepared depending on the intended use, and remelted at 1400° C. In this regard, in the reprepaaration, copper was added to the CFA50 as an eutectic copper-iron alloy to adjust the Cu/Fe ratio. In addition, in the remelting, the grown grains of the intermetallic compound were not decomposed. The molten reprepaaration was cooled to provide an ingot. Then, the ingot was subjected to hot forging at 800° C. to be formed into a billet for plastic working. It had been determined that this hot forging disordered crystals of dendrite, and improved the anisotropic property of the CFA as an eutectic copper-iron alloy to an isotropic property.

It is to be noted that while the respective embodiments and respective examples of the present invention have been described in detail as mentioned above, one skilled in the art will easily understand that a large number of modifications can be made without substantively departing from the new matter and advantageous effect of the present invention. Accordingly, such modification examples are all to be considered included in the scope of the present invention.

For example, the term mentioned at least once along with a broader-sense or synonymous different term in the specification or the drawing can be replaced with the different term even anywhere in the specification or the drawing. In addition, the operation of the method for producing an eutectic copper-iron alloy is also not limited to the descriptions in the respective embodiments of the present invention, but various modifications can be made.

GLOSSARY OF DRAWING REFERENCES

10 . . . a primary reaction furnace, 12 . . . a first melting furnace, 14 . . . a second melting furnace, S101 . . . a charging step, S102 . . . a molten copper deoxidizing step, S103 . . . a molten iron deoxidizing step, S104 . . . a molten iron transfer step, S105 . . . a molten copper transfer step, S106 . . . a reaction step, S107 . . . a molten mixture transfer step, S108 . . . a cooling step, S109 . . . a reprepaaration necessity determination step, S110 . . . a reprepaaration step, S111 . . . a processing step

The invention claimed is:

1. A method for producing an eutectic copper-iron alloy including CFA (Cu—Fe Alloy) that is a copper-iron new ceramic in which crystal grain fragments containing iron are dispersed in a copper matrix, the method comprising:

a charging step of charging a first melting furnace with electrolytic copper, and a second melting furnace with pure iron grain fragments, in which the second melting furnace is separated from the first melting furnace;

a molten copper deoxidizing step of heating and thus melting the electrolytic copper to 1400° C. in the first melting furnace, thus deoxidizing an oxygen-containing gas in the molten copper;

a molten iron deoxidizing step of heating and thus melting the pure iron to 1600° C. in the second melting furnace, thus deoxidizing an oxygen-containing gas in the molten iron;

a molten iron transfer step of further increasing a temperature of the molten iron generated in the second melting furnace to 1650° C., and then transferring the molten iron to a primary reaction furnace which is separated from the first melting furnace and the second melting furnace;

a molten copper transfer step of increasing a temperature of the molten copper generated in the first melting furnace to 1550° C. after the molten iron transfer step, and then transferring the molten copper to the primary reaction furnace;

a reaction step of heating the primary reaction furnace to 1600° C. and causing a crystallization reaction between copper contained in the molten copper and iron contained in the molten iron in the primary reaction furnace;

a molten mixture transfer step of transferring a molten mixture generated in the primary reaction furnace into a mold;

a cooling step of cooling the molten mixture transferred into the mold; and a processing step of processing a cast product generated in the mold.

2. The method according to claim 1, wherein high-frequency electric furnaces are used as the primary reaction furnace, the first melting furnace, and the second melting furnace.

3. The method according to claim 1, wherein a deoxidizing agent containing at least silicon is added into the molten copper in the molten copper deoxidizing step.

4. The method according to claim 1, wherein a deoxidizing agent containing at least ferrosilicon is added into the molten iron in the molten iron deoxidizing step.

5. The method according to claim 1, wherein the molten mixture is transferred into a mold that forms a sheet bar from the molten mixture in the molten mixture transfer step, and then rapidly cooled to 100° C. or lower in the cooling step.

6. The method according to claim 1, wherein the molten mixture is transferred into a mold that forms a billet from the molten mixture in the molten mixture transfer step, and then slowly cooled to 300° C. or lower in the cooling step.

7. The method according to claim 1, wherein the cast product is subjected to hot forging to be formed into a billet for plastic working in the processing step.

* * * * *